US005928549A

United States Patent [19]

Hitzigrath

[11] Patent Number: 5,928,549

[45] Date of Patent: Jul. 27, 1999

[54] ETCHED FOIL HEATER FOR LOW VOLTAGE APPLICATIONS REQUIRING UNIFORM HEATING

[75] Inventor: Richard W. Hitzigrath, Sayville, N.Y.

[73] Assignee: Cox & Company, Inc., New York, N.Y.

[21] Appl. No.: 08/822,623

[22] Filed: Mar. 21, 1997

[51] Int. Cl.[6] ..... H05B 3/10; H01C 3/10

[52] U.S. Cl. ..... 219/548; 219/552; 219/538; 338/284; 338/289; 338/291; 338/293

[58] Field of Search ..... 219/203, 213, 219/522, 528, 535, 543, 544, 547; 338/284, 287, 288, 289, 291, 293

[56] References Cited

U.S. PATENT DOCUMENTS 3,468,011 9/1969 Curtis ..... 29/620

4,144,473 3/1979 Almer ..... 313/315

5,475,204 12/1995 Giamati et al. ..... 219/548

*Primary Examiner*—Teresa Walberg

*Assistant Examiner*—Thor S. Campbell

[57] ABSTRACT

A serpentine etched foil heater has a segmented serpentine conductor group made up of a plurality of spaced-apart elongated serpentine conductive strips that are connected in parallel and are everywhere aligned with each other. Advantageously, central conductive strips are wider than are conductive strips along the edges. Further advantageously, the conductive strips are bridged by conductive regions that extend along lines of constant voltage. This makes it possible to handle the heater element without causing it to become tangled. The heater is especially suitable for low voltage applications.

8 Claims, 4 Drawing Sheets

ETCHED FOIL HEATER FOR LOW VOLTAGE APPLICATIONS REQUIRING UNIFORM HEATING

BACKGROUND OF THE INVENTION

The invention relates to etched foil heaters, and particularly relates to etched foil heaters of the low voltage type. In its most immediate sense, the invention relates to high output, low voltage etched foil heaters for applications in which a comparatively large area must be heated.

Etched foil heaters use conductive foil that is etched to form a serpentine pattern. During manufacturing, the foil is mounted to a backing and then etched into the desired pattern. The etched foil is then laid up in a dielectric matrix (e.g. silicone), connections (e.g. conductive foil tabs or wires) are led out of the matrix, and the matrix is then cured (removing the backing if necessary).

In an etched foil heater element, the conductive path is quite wide as compared to its thickness. Such a heater develops "hot spots" and "cold spots" at locations where the path changes direction. This is particularly evident at locations where the path makes a 180° turn around a small radius.

Such hot spots and cold spots are caused by a phenomenon known as "current crowding". When electric current flows in a straight line through a wide foil conductor, the current density is fairly constant across the width of the conductor. However, when such a wide foil conductor changes direction, and particularly when it makes a 180° turn, the current density is much higher at the inside of the turn. In general, this is because the conductive path has a minimum length—and therefore a minimum resistance—at the inside of the turn, and the electric current tends to flow along the path of least resistance. This increased current density produces a hot spot at the inside of the turn, and it can be shown that the heat flux (in watts/cm$^2$) at a particular turn radius is approximately proportional to the inverse square of the turn radius. Put another way, the inside of each turn will have an excessive current density (high heat flux) and the outside of each turn will have a low current density (low heat flux). Therefore, at each 180° turn, an etched foil heater will have a temperature gradient across the turn; the inside radius of the turn will be hotter than the outside radius.

In typical etched foil heater patterns, the magnitude of this temperature gradient is significant. As a result, the phenomenon of current crowding limits the maximum width of the foil conductor. This limitation, in turn, has undesirable consequences, especially when the heater is of the low voltage, high output type and is used for a low temperature application.

These consequences flow from two characteristics of a heater used for high output, low voltage applications: 1) the resistance of the heater element must be low to produce a high output; and 2) the resistance of a conductor is inversely proportional to the conductor's cross-sectional area. Because of these two characteristics, limiting the width of the foil (to in turn limit the temperature gradient across the turns of the heater element) means the foil must be thicker to keep the overall heater element resistance sufficiently low. This reduces the foil's base area or "footprint", which is critical to good heat transfer into the matrix. This also makes the foil stiffer and less tolerant of thermal expansion effects (which tend to delaminate the heater element from the matrix in which it is enclosed).

One approach to minimizing current crowding is to break the wide foil path into many parallel paths. However, when the current path is broken up into many relatively narrow parallel paths the heater element becomes more difficult to handle during the manufacturing process. This is because the many narrow foil strips can easily become twisted, tangled and damaged as they catch on each other. Furthermore, as the foil strips become thicker and narrower, they increasingly take on the characteristics of wire conductors, which would have a relatively high local heat flux out of the heater element and into the surrounding matrix. This is because the foil has a relatively small footprint, so that the heat produced by the heater element is distributed over a comparatively small surface area. Such a relatively high local heat flux can produce relatively high temperatures, which reduce life and reliability.

It would be advantageous to provide a low voltage, high output (low resistance), etched foil heater for applications requiring a uniform heat flux at a low temperature, in which the heater element would be easy to handle.

The invention proceeds from the realization that the wide serpentine conductor of an etched foil heater can be divided up into a plurality of parallel strips having the equivalent overall resistance. Therefore, in a serpentine etched foil heater in accordance with the invention, the heater comprises a segmented serpentine conductor group made up of a plurality of spaced-apart elongated serpentine conductive strips that are connected in parallel and are everywhere aligned with each other. Because the single wide conductor has been replaced by a plurality of comparatively narrow ones, the current crowding effect is reduced within each individual path.

In the preferred embodiment, the widths of the conductive strips are selected to correspond to the radii of curvature that the conductive strips are required to assume. Therefore, a conductive strip that will lie at the most inside position of a 180° turn is made narrowest, and a conductive strip that will lie along a larger radius of a 180° turn is made wider. In practice, this means that the conductive strips are widest at the center of the conductor group and narrowest at the radially outermost edges of the conductor group. This is because the serpentine nature of the heater causes radially inwardly conductive strips to be located at radially outward positions at adjacent turn locations along the conductive path. The exact pattern of foil widths, from narrowest at the edges to widest in the center, is determined by an analysis that takes into account the current crowding heat flux (which follows the inverse square of the radius) and the thermal conductance of the foil (which tends to spread the heat within the wire). Advantageously although not necessarily, each conductive strip has a constant width, and all the conductive strips are kept equally long. This is conveniently accomplished by using an odd number of 180° turns.

In the preferred embodiment, the heater is made easier to handle by physically interconnecting the parallel conductive strips. This is accomplished by bridging across adjacent strips using conductive regions that extend along lines of constant voltage. Because such regions have equal voltages at their endpoints, no current flows through them and they have no effect on the heat flux produced by the heater. This overcomes the handling difficulties that would ordinarily be associated with an etched foil heater element having many turns and many parallel conductive paths, and eliminates the need for a carrier such as KAPTON®.

BRIEF DESCRIPTION OF THE DRAWINGS

The invention will be better understood with reference to the following illustrative and non-limiting drawings, in which.

DETAILED DESCRIPTION OF PREFERRED EMBODIMENTS

Figure 1:
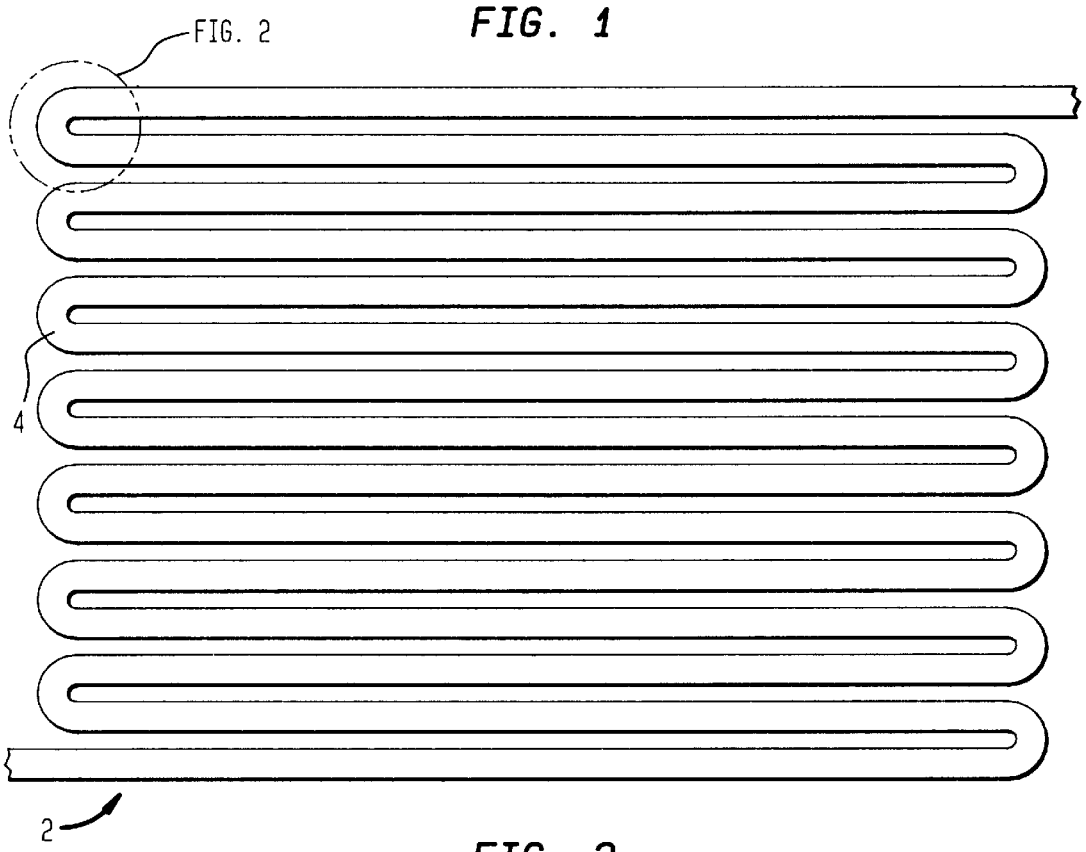
FIG. 1 shows a conventional serpentine etched foil heater element.

The drawings are not to scale, and have been selectively exaggerated for clarity.

In a conventional serpentine etched foil heater generally indicated by reference numeral 2, there is at least one conductive path generally indicated by reference numeral 4. (There may be more than one such path, and such paths may be interleaved, but for clarity, only one such path is shown.)

As illustrated, the heater 2 is intended to produce a high output when connected to a low voltage source. The conductive path 4 is therefore of low resistance (in Ω) and consequently is comparatively large in cross-section (i.e. wide).

Figure 2:
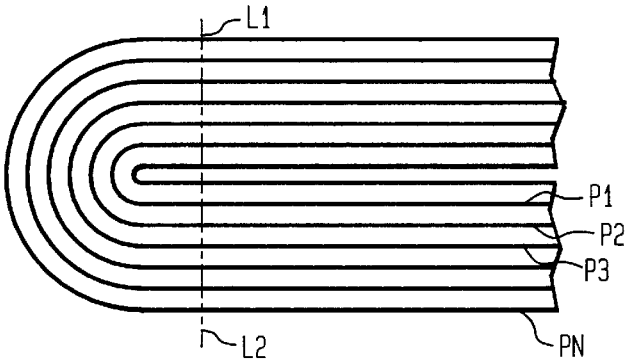
FIG. 2 shows why a conventional serpentine etched foil heater has hot spots and cold spots at its 180° turns.

For purposes of illustration, and as shown in FIG. 2, the above-described conductive path 4 may be considered to be a large number of equally thin conductive paths P1, P2, P3 . . . PN. FIG. 2 shows that the total resistance of the path P1 between locations L1 and L2 is at a minimum because the length of the path P1 between those locations is shorter than the length of any other one of the paths P2 . . . PN. Likewise, the total resistance of the path PN between locations L1 and L2 is at a maximum because the length of the path PN between those locations is larger than any other one of the paths P1 . . . PN−1.

From this, it may be understood that the current density in the path 4 is not uniform around a 180° turn. Current density is highest where the path resistance is lowest (i.e. at the inside of the turn) and lowest where the path resistance is highest (i.e. at the outside of the turn). Using this simplified model of a turn, the current density in the foil at a particular radius of curvature is approximately proportional to the inverse of the radius of curvature. Because the footprint area of each elemental path is likewise proportional to the local radius, the heat flux produced by the foil at a particular radius of curvature is therefore approximately proportional to the inverse square of the radius of curvature. Consequently, wherever the path 4 makes a 180° turn, there will be a hot spot at the inside of the turn and a cold spot at the outside of the turn.

Thus, when a conventional high output, low voltage heater uses a serpentine etched foil heater element, the heater temperature varies and the heater has hot spots. These hot spots constrain the size and output capacity of the finished heater. This is because the maximum temperature of the heater element must be limited to avoid damaging the low-temperature matrix (e.g. silicone) in which the heater element is enclosed.

In accordance with preferred embodiments of the invention, the conductive path 4 is made up of a plurality of spaced-apart elongated serpentine conductive strips that are connected in parallel and are everywhere aligned with each other. Furthermore, while the width of each strip remains constant, the widths of the strips vary from strip to strip so that the central strip(s) are widest and the width of the strips decreases from the center of the path 4 towards the edges of the path 4.

Figure 3:
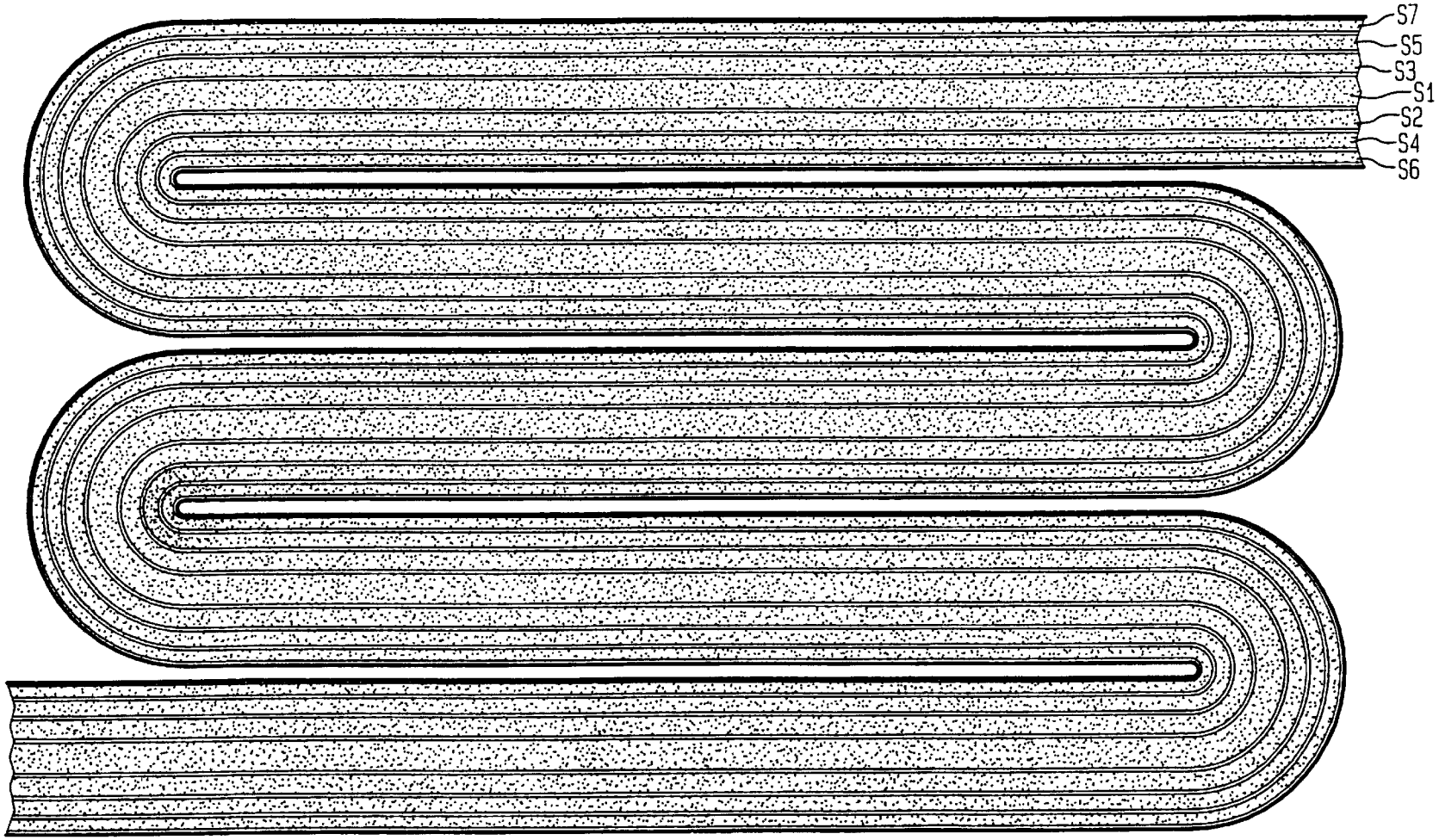
FIG. 3 schematically illustrates an embodiment of the invention having seven conductive strips.

Thus, as is illustrated in FIG. 3, the path 4 may advantageously divided into seven serpentine conductive strips S1, S2, S3, S4, S5, S6, and S7. The central strip S1 is the widest one of the strips S1 . . . S7. Strips S2 and S3, each of which is located on one of the sides of the strip S1, are equally wide, but narrower than the strip S1. Strips S4 and S5, which are located radially outwardly of strips S2 and S3, are equally wide, but are narrower than the strips S2 and S3. Strips S6 and S7, which are located at the edges of the path 4, are equally wide, but are narrower than the strips S4 and S5.

The embodiment illustrated is intended for an air heater in which 2.56 kW of electrical power at 28 VDC is to be supplied to an airstream. The heater temperature may not exceed 450° F. and the heater element may not be larger than 128 $in^2$. In this embodiment, the strips S1 . . . S7 have the following dimensional arrangement:

S1 is 0.068 inches wide.

S2 and S3 are 0.055 inches wide.

S4 and S5 are 0.040 inches wide.

S6 and S7 are 0.030 inches wide.

Adjacent strips (e.g. strips S4 and S6) are spaced apart by 0.024 inches.

Adjacent loops of the path 4 are spaced apart by 0.041 inches. Spacing dimensions are sized to fit the overall heater area.

The path 4 need not be divided into an odd number of conductive strips S1, S2 . . . SN. It may alternatively be divided into an even number of strips, e.g. four strips S1, S2, S3 and S4. In this design alternative, the central strips S1 and S2 are equally wide and the edge strips S3 and S4 are also equally wide, but are narrower than the strips S1 and S2.

It will be understood that the number of conductive strips and the dimensions of each strip need not be exactly as shown and will be selected to match the intended application. For example, for applications in which a comparatively high temperature gradient can be tolerated, it may only be necessary to use a comparatively small number of conductive strips (e.g. two or three strips) and to make them all approximately the same width. Alternatively, for applications requiring extremely uniform temperature, many conductive strips (e.g. five or more strips) may be required, the strips may be arranged in pairs of precisely varying widths, and the widths of all the conductive strips may vary together in accordance with position. For whatever number of strips are used, the widths of the strips are maximized, consistent with the maximum allowable temperature gradients across each strip.

As presently contemplated, the maximum allowable temperature gradient ΔT across any particular strip is approximately 20° F. It is known that the heat transfer (Q) within each strip across the foil is proportional to the thickness and width of the foil $$Q=k\cdot A\cdot(\Delta T/\Delta X)$$

wherein k=the thermal conductivity of the foil

A=foil thickness x foil length

ΔT=temperature gradient across foil strip

ΔX=width of foil strip

It is therefore beneficial to vary ΔX as a function of the radius of curvature of the foil strip in such a manner as to keep ΔT to 20° F. or less.

The lower limit width of the conductive strips would be the width of a typical heater wire (e.g. about 0.007 inch) because the etched foil heater element would then be comparable to a wire heater element in terms of thermal performance, and etched foil heater elements are often preferred over wire heater elements because etched foil heater elements minimize the void space between heated regions and increase the footprint of the heater element.

Advantageously, all of the strips S1 . . . SN have identical lengths. This will equalize the heat flux produced by each of the strips S1 . . . SN; because the foil is of constant thickness, the heat flux (in w/in$^2$) delivered to the supporting matrix (e.g. silicone) by each strip S1 . . . SN depends only upon the length of the strip S1 . . . SN and not upon the width of the strip S1 . . . SN. Accordingly, in accordance with the preferred embodiment of the invention as shown in FIG. 5, there are an even number of 180° turns.

Figure 4:
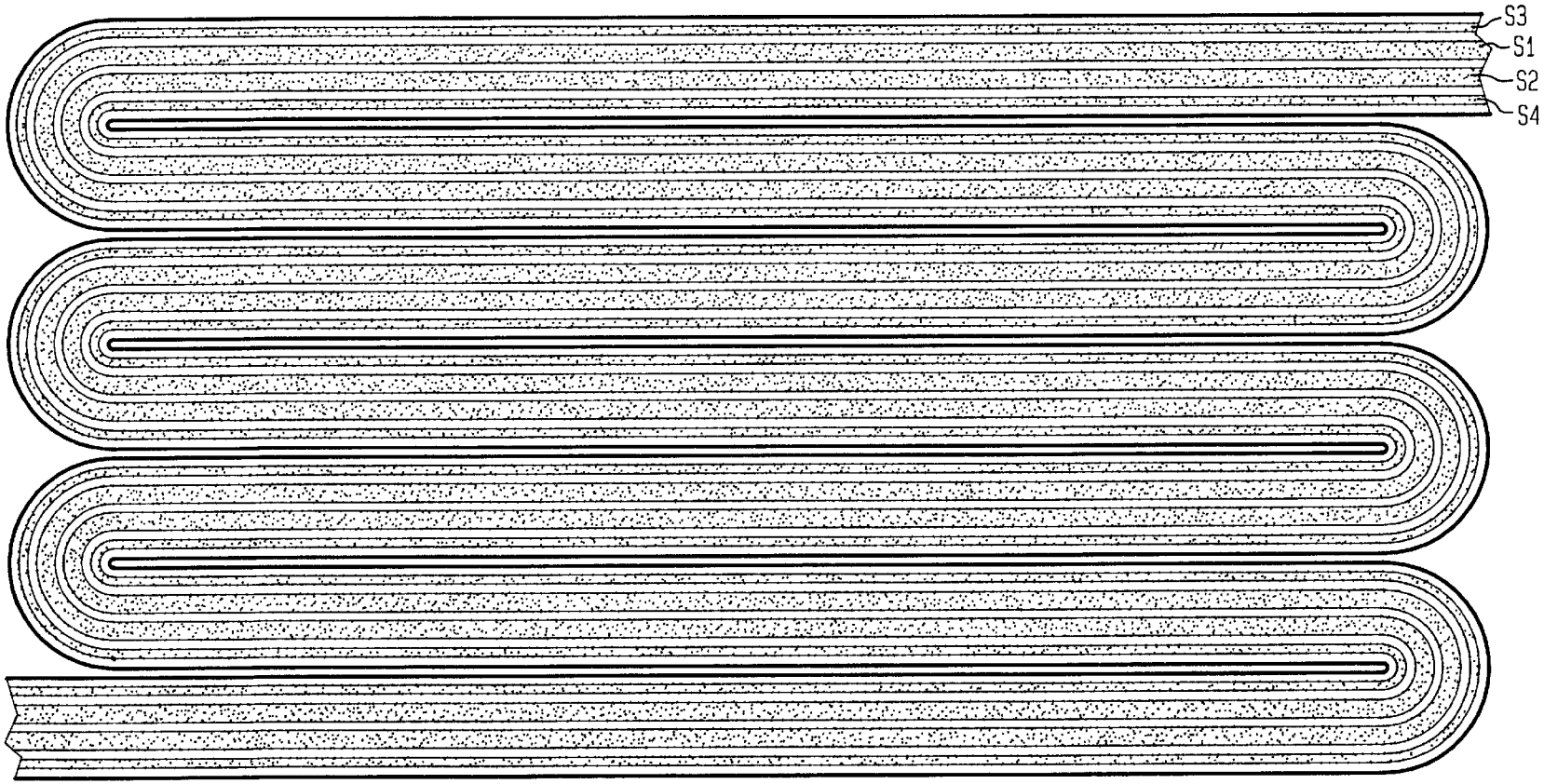
FIG. 4 schematically illustrates an alternate embodiment of the invention having four conductive strips.

If the matrix is vulcanized in silicone or some other matrix it may become required, as part of the manufacturing process, to handle a heater such as is illustrated in FIGS. 3 and 4. The etched foil heating element would then likely become tangled up when it was being handled. Accordingly, in accordance with the preferred embodiment illustrated in FIG. 5, conductive regions R1A, R1B, R1C, R2A, R2B, R2C, R3A, R3B, R3C bridge across adjacent strips along lines of constant voltage. Because each of the conductive regions R1A, R1B, R1C, R2A, R2B, R2C, R3A, R3B, R3C is everywhere at the same voltage, current does not flow through any one of them and the conductive regions R1A, R1B, R1C, R2A, R2B, R2C, R3A, R3B, R3C do not affect the heat output of the heater.

Figure 5:
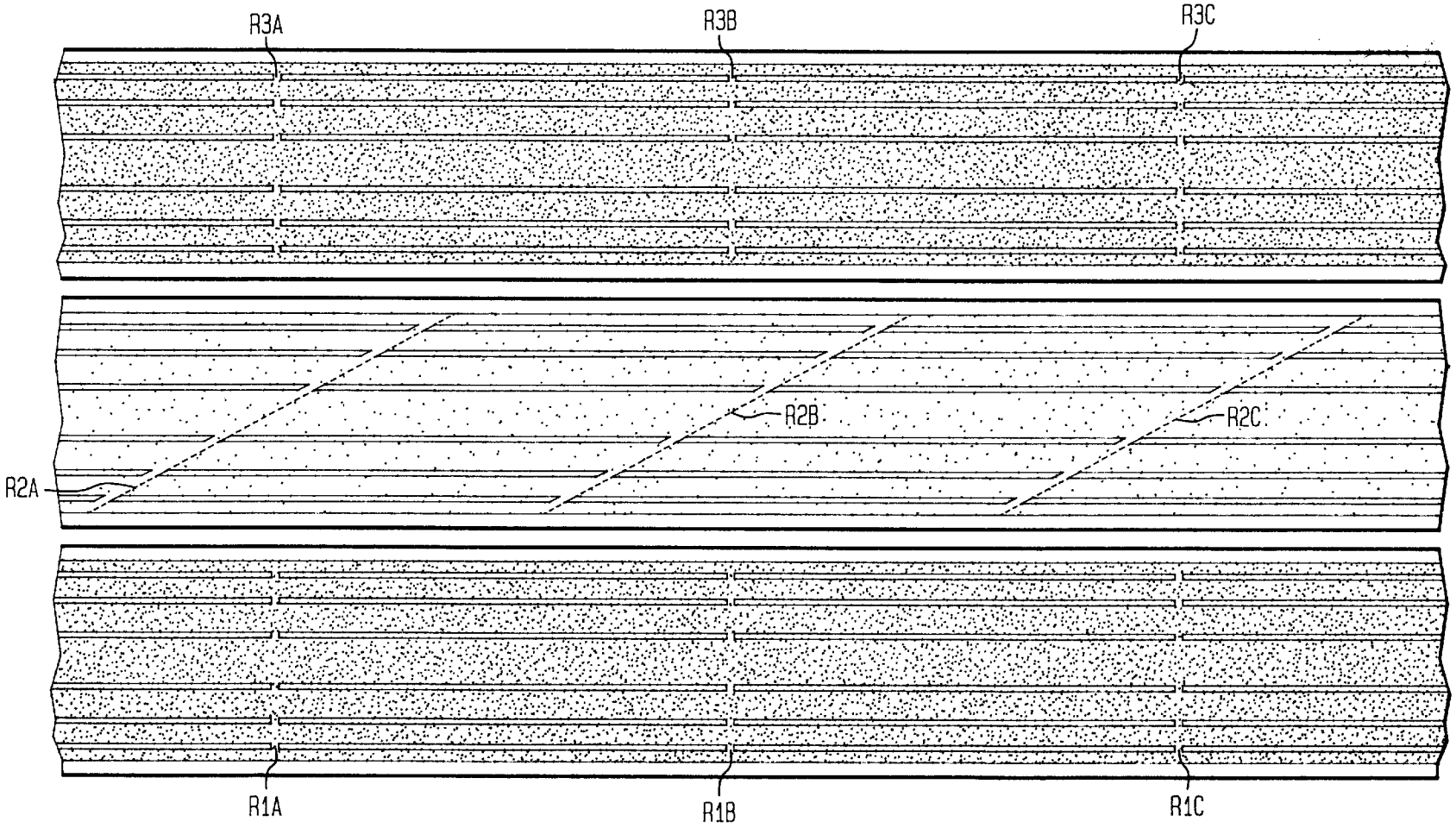
FIG. 5 shows conductive regions along lines of constant voltage in a preferred embodiment of the invention.

As can be seen in FIG. 5, the regions R1A, R1B, R1C, R3A, R3B, R3C etc. are orthogonal to the strips S1 . . . S5, while the regions R2A, R2B, R2C, etc. are at an angle to the strips S1 . . . S5. This is because the local voltage drop between any two points along a path depends predominantly on the percentage of total path length between those points.

The number of regions R1A, R1B, R1C, R2A, R2B, R2C, R3A, R3B, R3C is not a part of the invention. Advantageously, they are placed sufficiently close together to make the finished heater easy to handle, but not so close together that the foil is difficult to etch accurately.

Although at least one preferred embodiment of the invention has been described above, this description is not limiting and is only exemplary. The scope of the invention is defined only by the claims, which follow:

I claim:

1. A serpentine etched foil heater, comprising a segmented serpentine conductor group made up of a plurality of spaced-apart elongated serpentine conductive strips that are connected in parallel and are everywhere aligned with each other.

2. The heater of claim 1, wherein the conductor group has an even number of conductive strips arranged symmetrically with respect to a centerline, and wherein centrally located conductive strips have greater widths than non-centrally located conductive strips.

3. The heater of claim 2, wherein the conductor group has an even number $\geqq 4$ of conductive strips, wherein each of two central conductive strips has a width W, and wherein all other conductive strips have widths $\leqq$W.

4. The heater of claim 1, wherein the conductor group has an odd number of conductive strips, wherein a central one of said conductive strips is aligned with a centerline and all other conductive strips are arranged symmetrically with respect to the centerline, wherein said central one has a width W, and wherein all other conductive strips have widths $\leqq$W.

5. The heater of claim 4, wherein the conductor group has an odd number $\leqq 5$ of conductive strips including a central conductive strip and at least 2 pairs of non-central conductive strips extending outwardly to an outermost pair of conductive strips, and wherein the conductive strips have widths that progressively diminish from said central conductive strip towards said outermost pair of conductive strips.

6. The heater of claim 1, wherein the conductive strips are bridged by conductive regions that extend along lines of constant voltage.

7. The heater of claim 1, wherein all the conductive strips are equally long.

8. The heater of claim 1, wherein each conductive strip has a constant width.

* * * * *

UNITED STATES PATENT AND TRADEMARK OFFICE

CERTIFICATE OF CORRECTION

PATENT NO. : 5,928,549
DATED : July 27, 1999
INVENTOR(S) : Richard W. Hitzigrath

It is certified that error appears in the above-identified patent and that said Letters Patent is hereby corrected as shown below:

Claim 5, line 2: change "≤" to --≥--.

Signed and Sealed this

Twenty-sixth Day of September, 2000

*Attest:*

Q. TODD DICKINSON

*Attesting Officer*

*Director of Patents and Trademarks*